US008574099B2

(12) United States Patent
Sells

(10) Patent No.: US 8,574,099 B2
(45) **Date of Patent: *Nov. 5, 2013**

(54) PAR ONE

(76) Inventor: Gary L. Sells, South Bend, IN (US)

( * ) Notice: Subject to any disclaimer, the term of this patent is extended or adjusted under 35 U.S.C. 154(b) by 11 days.

This patent is subject to a terminal disclaimer.

(21) Appl. No.: 12/661,324

(22) Filed: Mar. 15, 2010

(65) Prior Publication Data

US 2010/0171262 A1 Jul. 8, 2010

Related U.S. Application Data

(60) Continuation-in-part of application No. 11/953,894, filed on Dec. 11, 2007, now Pat. No. 7,677,991, which is a division of application No. 11/163,879, filed on Nov. 2, 2005, now Pat. No. 7,318,777.

(51) Int. Cl.
*A63B 69/36* (2006.01)

(52) U.S. Cl.
USPC ..... 473/409; 473/168; 273/112; 273/120 R; 446/168; 463/69

(58) Field of Classification Search
USPC ..... 473/167–170, 513, 409; 273/138.3, 273/445; 463/59, 60, 69; 446/168
See application file for complete search history.

(56) References Cited

U.S. PATENT DOCUMENTS

| | | | | |
|---|---|---|---|---|
| 1,524,378 | A | 1/1925 | Antes | |
| 2,195,634 | A | 4/1940 | Shelley, Jr. | |
| 2,455,806 | A * | 12/1948 | Reach | 473/169 |
| 2,490,961 | A * | 12/1949 | Hendry | 473/168 |
| 2,936,179 | A | 5/1960 | Thurston | |
| 3,092,928 | A | 6/1963 | Geiser | |
| 3,104,879 | A | 9/1963 | Jetton | |
| 3,458,195 | A | 7/1969 | Neubeck | |
| 3,578,333 | A | 5/1971 | Elesh | |
| 3,599,980 | A | 8/1971 | Harmond | |
| 3,708,173 | A | 1/1973 | Hewson, Jr. | |
| 3,711,094 | A | 1/1973 | Coffman | |
| 3,917,279 | A | 11/1975 | Barber | |
| 3,989,249 | A | 11/1976 | Breslow | |
| 4,171,812 | A | 10/1979 | Marsin | |
| 4,202,547 | A | 5/1980 | Mueller | |
| 4,726,589 | A | 2/1988 | Grigas | |
| 4,846,478 | A | 7/1989 | Saint-Cricq | |
| 4,989,876 | A | 2/1991 | Hawkins, Sr. et al. | |
| 5,029,867 | A | 7/1991 | Johnson | |
| 5,112,054 | A | 5/1992 | Oswald | |
| 5,129,650 | A | 7/1992 | Hayman | |
| 5,219,161 | A | 6/1993 | Williams, Sr. | |
| 5,370,389 | A | 12/1994 | Reising | |
| 5,439,224 | A | 8/1995 | Bertoncino | |
| 5,505,452 | A | 4/1996 | Meaden | |
| 5,513,841 | A | 5/1996 | Takagi | |
| 5,549,295 | A | 8/1996 | Goldring | |
| 6,083,114 | A | 7/2000 | Bailey | |
| 6,338,682 | B1 | 1/2002 | Torchia et al. | |
| 6,569,028 | B1 | 5/2003 | Nichols et al. | |
| 2004/0214648 | A1 | 10/2004 | Simpson | |

* cited by examiner

*Primary Examiner* — Mark Graham
(74) *Attorney, Agent, or Firm* — Faegre Baker Daniels LLP

(57) ABSTRACT

A golf system that includes a tee or other area for striking a golf ball; and a golf green having a concave surface with a ball receptacle located at the lowest point in the surface so that a ball landing and remaining on the green will roll into the ball receptacle. The green includes a resiliently compressible layer coinciding with the concave surface. The resiliently compressible surface may include at least one layer of corrugated plastic material and may be covered with an artificial turf surface. The golf system may be used to play a unique game, wherein a plurality of balls are rolled on the green and travel in a spiral manner into the ball receptacle. The golf green may be mounted on a portable frame.

14 Claims, 7 Drawing Sheets

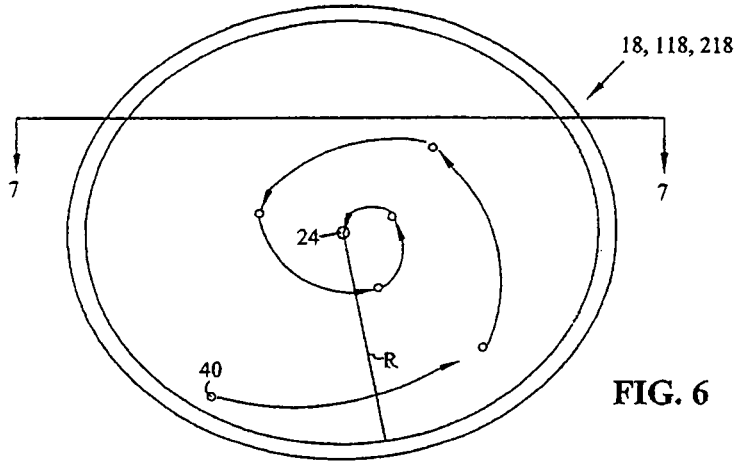
FIG. 6
FIG. 7
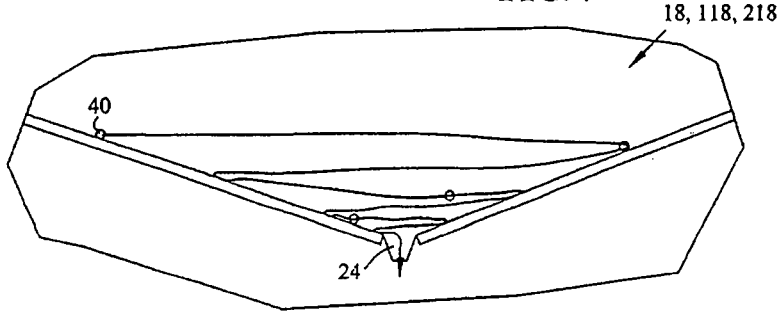

PAR ONE

This application is a Continuation-In-Part application of and claims priority from U.S. patent application Ser. No. 11/953,894 filed Dec. 11, 2007, now U.S. Pat. No. 7,677,991 which is a Division of U.S. patent application Ser. No. 11/163,879 filed Nov. 2, 2005, now U.S. Pat. No. 7,318,777 which are incorporated in their entirety by reference herein.

BACKGROUND

This invention relates to a golf green and, in particular, to a golf green having a concave surface to facilitate a ball that lands and stays on the green to gravitate toward and enter the hole therein.

Golf is an extremely popular game and numerous course designs and games have been developed for golfers to use to increase their skill and practice play. One of the ways in which players develop their golf skills is by going to a driving range. Driving ranges enable a golfer to practice with a particular club or stroke over and over by hitting a multitude of balls from a single tee. It is typical for a driving range to have yardage markers so that golfers can get an indication of how far a hit ball traveled.

In addition, some golf driving ranges place golf greens in the driving field of the driving range so that golfers may try to improve their distance and accuracy by hitting onto the golf greens. One of the shortcomings with such greens is that, after many balls become deposited on the green, it is difficult for a golfer to determine whether the most recently struck ball landed on the green or not.

Other golf practice greens and targets previously known include U.S. Pat. No. 2,936,179 to Thurston. Thurston discloses a golf target having a trap receptacle including a conical flexible bag. If a golf ball lands in the trap receptacle, it travels through a spout in the bottom of the conical bag and out a conductor where it triggers a signal means that the ball was successfully received in the trap receptacle. The signal means disclosed is a flag on a staff that is raised when the trap receptacle receives a ball and it travels through the conductor.

A concentrated golf game is disclosed in U.S. Pat. No. 3,599,980 to Harmond. Harmond discloses a golf course including an enclosed area of land at one end of an elongated fairway. The enclosed area includes driving tees, ball dispensers, and putting greens. The fairway is generally dish-shaped and includes a plurality of target greens. Balls are returned to dispensers on the tees by a pneumatic system connected to cups in the putting greens and an opening at a low point of the dish-shaped fairway where balls are collected.

U.S. Pat. No. 3,917,279 to Barber discloses a golf game apparatus that includes a green having a concave recess adjacent the hole or cup. The recess has a radius of about 18 inches to 36 inches from the center of the cup so that a ball coming within the radius of the recess will tend to roll toward and enter the cup.

A compact golf course is disclosed in U.S. Pat. No. 4,726,589 to Grigas. The course is divided into a plurality of sections by intersecting covered passageways, which enable the golfer to transmit common fairway shots between greens and tees disposed around the perimeter of the course. Balls falling within the interior of the course are collected by the sections and transported to covered hitting areas accessible by the passageways. The sections include an incline surface that slopes downwardly towards a ball receiving means such that golf ball deposited within the section rolls into the receiving means and thereafter into a means for transporting the ball to the appropriate hitting area.

U.S. Pat. No. 4,846,478 to Saint-Cricq discloses a game for practicing golf, and an installation is provided that includes at least one green with a hole. A device for recovering balls from the green that are in the vicinity of the green is also provided. The installation also includes an arrangement enabling the player to evaluate the precision of his strokes and measure his skill alone or with respect to other players. The device for recovering the balls includes a rotating rake that pushes the balls into a trough.

Another compact golf course is disclosed in U.S. Pat. No. 5,112,054 to Oswald. The course includes a common putting green containing nine holes and target greens designed to automatically clear balls from the surface. The target greens are sloped and have a collection receptacle extending along a lower portion thereof where balls roll and are collected.

U.S. Pat. No. 5,219,161 to Williams discloses a golf driving range with an apparatus adapted for use as a green. The apparatus includes a self-clearing means for preventing golf balls, which land on the green surface, from remaining there. The self-clearing of golf balls is accomplished by either shaping the green surface so the balls inherently roll off the green or providing a mechanism, which raises and lowers one end of the green surface in order to clear the balls. The cup in the green includes a sensor for identifying the ball and a signal light or horn to indicate when a ball has entered the hole. The green also includes impact sensors for designating when the ball lands on the green.

A golf range method and apparatus are also disclosed in U.S. Pat. No. 5,370,389 to Reising. The method and apparatus include greens, wherein if a player lands a ball in one of the greens, it triggers a score on the visual display that is located near the teeing area so that the player can easily see the score. Each of the greens is sloped so that a ball that lands on a green's surface will roll into a hole located at the lowest point of the surface. Each of the balls has a distinctive marking, either a color code or a bar code, so that the sensor can determine from which tee the ball was hit. The score from the player landing the ball on the green is then added to a visual display corresponding with each tee. The greens include a fabric or canvas surface and a ball ejector mechanism.

Another driving range and an automated scoring system are disclosed in U.S. Pat. No. 5,439,224 to Bertoncino. The golf range includes a series of independent targets, each of which consists of a sloped area, located at different distances. The range is equipped with a scoring system that uses a UPC code on the balls and optical scanners located in the targets so that each golfer's score can be computed and recorded. The targets include ringed sections and a cup located at a low portion of each section so that a ball landing in any particular section will automatically roll toward the cup, wherein the ball will be scanned for the UPC code.

Another golf driving range is disclosed in U.S. Pat. No. 6,569,028 to Nichols et al. The system disclosed by Nichols includes a golf target, a detection system, and a golf-ball dispensing system. The target area includes a frame and barrier netting that provides an immediate indication when the target is struck, such as by a change in illumination. The netting also includes drooping regions, wherein the balls are collected in the drooping region.

A drawback of the prior art is that the green may not have desirable landing characteristics for receiving the ball. That is, some of the greens are too hard so the ball may hit and bounce off of instead of rolling into the lower ball-receiving area or are too soft, such as the '028 patent to Nichols having a netting so that any ball landing therein is captured and will not rebound. Neither of these options is preferred, as it is desirable to have the green surface provide both some impact absorption and rebound that will enable a well-hit ball to stay on the green, yet will allow line drives or balls without proper spin to bounce off of the green. It is, therefore, one object of the present invention to provide a green having improved impact absorption and rebounding characteristics. These and other objects of the invention will become clearer in the detailed specification and attached drawings.

SUMMARY OF THE INVENTION

In one embodiment of the present invention, a golfing system is provided that includes a tee or other area for striking a golf ball with a club, and at least one golf green. The golf green has a generally concave configuration and a ball-receiving receptacle at a low point of the green. The green includes a moisture-proof underlayment of corrugated plastic.

The ball receptacle of the golf system may include a ball return line and a water drain line. The ball return can direct a golf ball entering the ball receptacle to travel on the ball return line to a ball dispenser located beyond the golf green. The golf system may also include a ball diverter in the ball receptacle that diverts any golf balls received in the receptacle to the ball return line. Moisture entering the ball receptacle passes by the ball diverter to the water drain line.

The golf system may include a ball sensor that activates an indicator when a ball is received in the ball receptacle.

The golf system may include four layers of the corrugated plastic underlayment.

The golf system may include artificial turf mounted on the corrugated plastic underlayment.

The corrugated plastic underlayment of the golf system may be mounted on a mound of soil or clay.

The rear of the green may be approximately one-and-one-half times higher than the front of the green. Also, the concave surface of the green may have approximately a 1:4 pitch. The golf system may also include a backstop behind the rear of the green.

It is an additional feature of the invention to provide an embodiment of a golf system that includes a tee or other area for striking a golf ball; and a golf green having a concave surface with a ball receptacle located at the lowest point in the surface so that a ball landing and remaining on the green will roll into the ball receptacle. The green includes a resiliently compressible layer coinciding with the concave surface.

The resiliently compressible surface may include at least one layer of corrugated plastic material.

Also, the resiliently compressible layer may be covered with an artificial turf surface.

Additionally, the concave surface may be angled at approximately a 1:4 pitch. The rear of the green may be approximately one-half times higher than the front thereof.

In another feature of the invention, the golf system may include a ball sensor that senses any ball that has been received in the receptacle.

Furthermore, the golf green may be mounted on a portable frame. The resiliently compressible layer can be mounted to a support surface attached to the frame.

It is also a feature of the invention to provide a method for playing a game on a golf green that includes the steps of providing a concave golf green having a ball receptacle located at a low point on the green; providing a plurality of golf balls being clearly distinguishable from one another by color or design; having one or more participants of the game each simultaneously rolling a golf ball on the green; the participants directing the rolled golf balls in a direction substantially perpendicular to the radii of the concave golf green; and monitoring said golf balls to determine in what order the balls enter the ball receptacle.

In one version of the method of playing a golf game, the last ball to enter the ball receptacle is the winner.

Also, the golf green may include at least one layer of corrugated plastic material.

Furthermore, in one embodiment, the method of playing a golf game has the concave golf green mounted on a portable frame.

BRIEF DESCRIPTION OF THE DRAWINGS

The above-mentioned and other features and objects of this invention and the manner of obtaining them will become more apparent, and the invention itself will be better understood by reference to the following description of embodiments of the present invention taken in conjunction with the accompanying drawings, wherein:

FIG. 6 is a plan view showing a game played on the green of the subject invention;

FIG. 7 is a cross-sectional view taken along the line 7-7 in FIG. 6.

Figure 1:
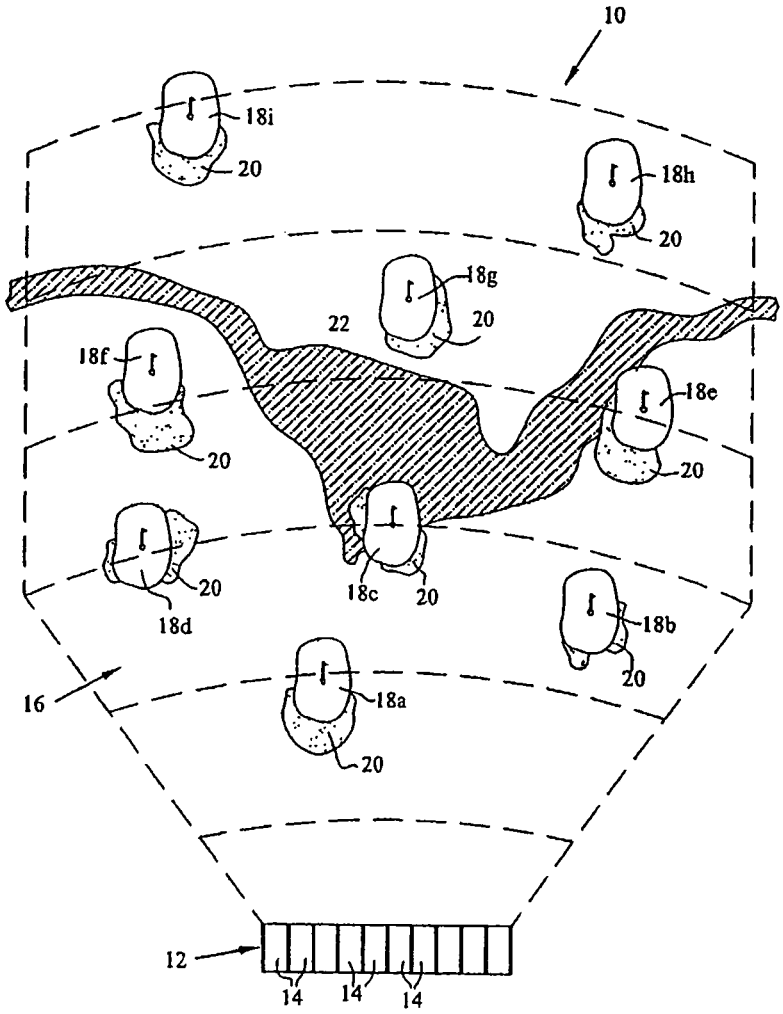
FIG. 1 is a perspective view of a driving range having greens in accordance with the subject invention.

Corresponding reference characters indicate corresponding parts throughout the several views. Although the drawings represent embodiments of the present invention, the drawings are not necessarily to scale and certain features may be exaggerated in order to better illustrate and explain the present invention. The exemplification set out herein illustrates embodiments of the invention, and such exemplifications are not to be construed as limiting the scope of the invention in any manner.

DETAILED DESCRIPTION OF THE DRAWINGS

For the purposes of promoting an understanding of the principles of the invention, reference will now be made to the embodiments illustrated in the drawings, which are described below. It will nevertheless be understood that no limitation of the scope of the invention is thereby intended. The invention includes any alterations and further modifications in the illustrated devices and described methods and further applications of the principles of the invention, which would normally occur to one skilled in the art to which the invention relates.

Referring now to FIG. 1, a golf driving range of the subject invention is shown generally indicated as 10. Golf driving range 10 includes a tee area generally indicated as 12 having individual ball-hitting regions 14 for allowing a plurality of players to hit balls adjacent one another. Golf driving range 10 also includes a fairway generally indicated as 16 from which players hitting from hitting regions 14 drive their golf balls into. Located in fairway 16 are a plurality of greens 18*a*-18*i*, and hazards such as sand traps 20 and water 22. It should be appreciated that in the embodiment shown greens 18*a*-18*i* are located at different angles and different distances from tee area 12 in fairway 16.

Figure 2:
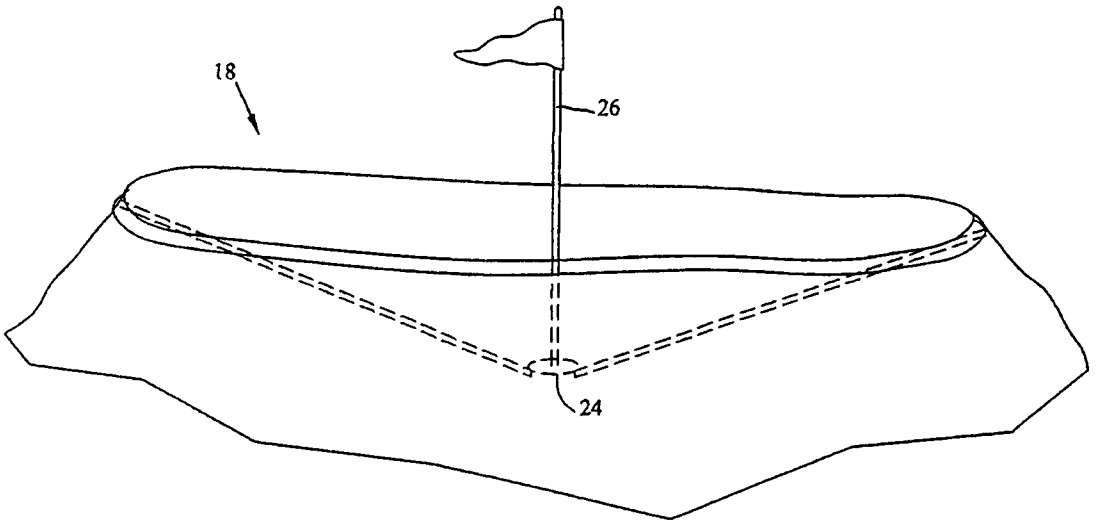
FIG. 2 is a perspective view of a single green showing the concave configuration thereof.
Figure 3:
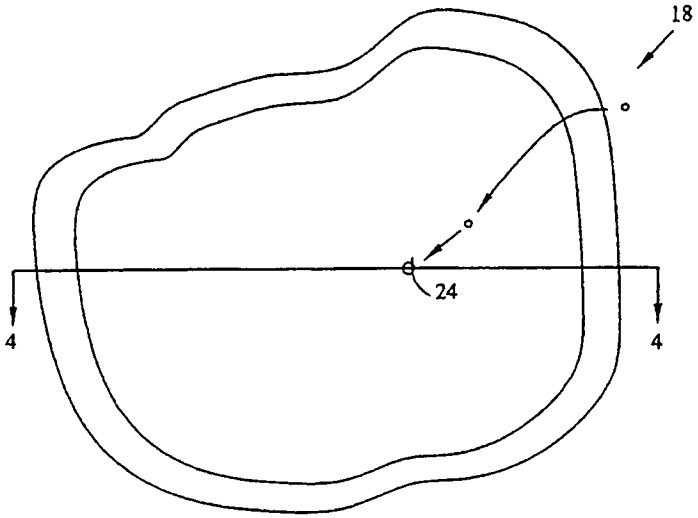
FIG. 3 is a top plan view of the green of FIG. 2.

Now referring to FIGS. 2 and 3, one of the greens of golf driving range 10 is selected and generally indicated as 18. As shown in FIG. 2, green 18 has a generally concave or funnel-shaped configuration and includes a hole generally indicated as 24 at the lowest point thereof. A flag 26 may be placed in hole 24, as a visual indicator as is well known. It should be appreciated from FIG. 3 that the outer shape of the golf green may be configured as desired so long as the green has a generally concave or funnel shape that directs the ball towards hole 24.

Figures 4, 4A:
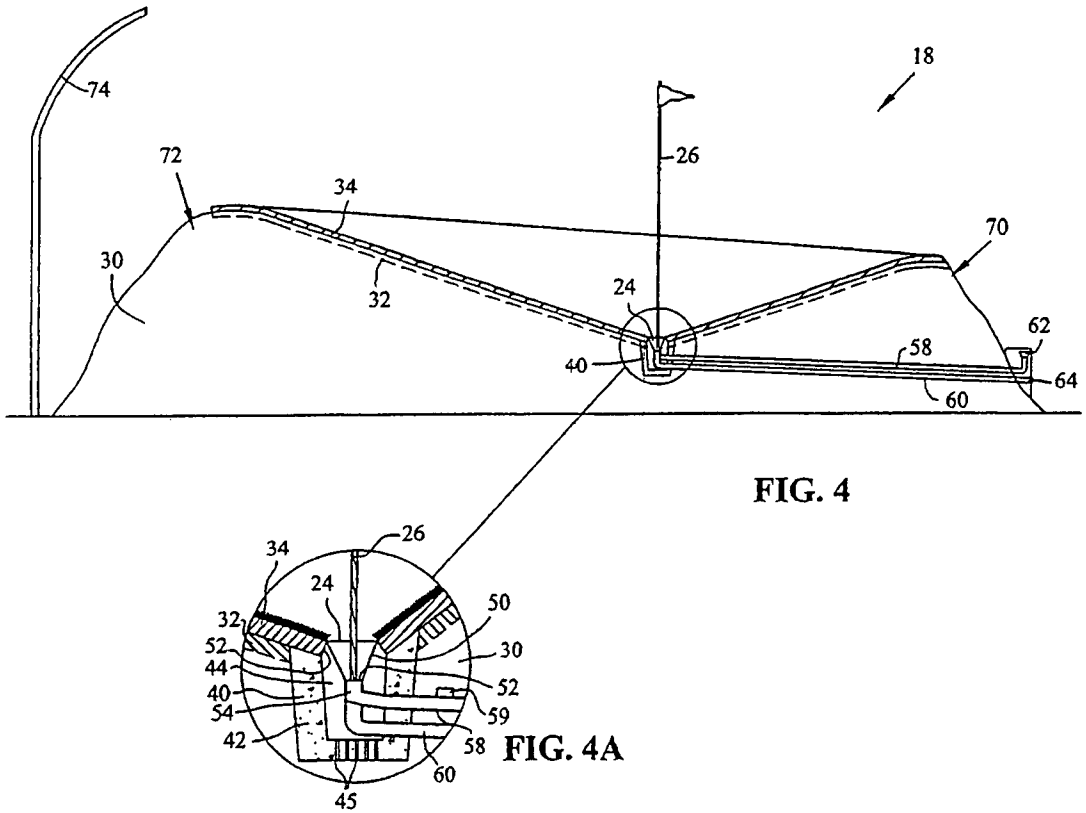
FIG. 4 is a cross-section of the green of FIG. 2 taken along the line 4-4 of FIG. 3.
FIG. 4A is an enlarged view of the area indicated in FIG. 4 showing the hole area.

Now referring to FIGS. 4 and 4A, green 18 is placed upon a soil or clay mound 30 and includes an underlayment support 32 and a surface 34. Underlayment support 32 is preferably of a moisture-resistant, non-corrosive material, such as plastic or fiberglass, and surface 34 may include an artificial turf surface, as is known, or a carpeting-type material. Beneath hole 24 is a ball-receiving receptacle generally indicated as 40. Ball-receiving receptacle 40 includes a casing or liner 42 and a cavity 44. Casing 42 is preferably of a moisture-resistant, non-corrosive material, such as a corrugated plastic, fiberglass, concrete or corrosion-resistant metal, and may include drain holes or perforations 45 to allow any water, snow or moisture that may accumulate in cavity 44 to drain therefrom into mound 30.

Contained in cavity 44 is a ball-receiving cup 50 of which an upper opening or mouth forms hole 24. It should be noted that an opening 52 is present in green 18 and extends through underlayment support 32 and surface 34 to provide a ball access to be received into ball-receiving cup 50. In the embodiment shown, cup 50 has a funnel or frustoconical shape with the base coinciding with hole 24. Cup 50 also contains a bottom opening 52 at the narrow end of the cup and a tube 54 aligned with and connected to opening 52, such that any ball or moisture received in cup 50 will be directed into tube 54 through opening 52.

Tube 54 contains a ball diverter 56 that directs any golf balls received in tube 54 into a ball return line 58 connected to the side of tube 54. Ball diverter 56 may include a partial obstruction in tube 54 that prevents a golf ball from traveling farther down through tube 54 and redirects it into ball return line 58. A sensor 59 may be placed in ball return line 58 to sense/detect a ball traveling therethrough. An audio or visual indicator (not shown) may be connected to sensor 59 to indicate that a ball entered hole 24. Connected to the bottom of tube 54 is a water drain line 60, where any moisture or snow received in tube 54 will gravitate. It should be appreciated that ball diverter 56 is designed so that any moisture passes through and around it down into water drain line 60, as opposed to diverting the water into ball return line 58.

Ball return line 58 and water drain lines 60 both extend through and exit mound 30 in the embodiment shown. A ball dispenser 62 is provided at the end of line 58 on the outside of mound 30, wherein golf balls entering hole 24 may be retrieved. Water drain line 60 ends in a water drain opening 64 so that any water that drains into hole 24 can be directed externally of mound 30. Ball dispenser 62 and water drain opening 64 may be provided with animal and vermin inhibitor grills (not shown) to inhibit pests from entering into the lines or ball-receiving receptacle.

Also as shown in FIG. 4, the front portion of green 18, which is generally indicated as 70 may be lower than the rear portion, which is generally indicated as 72. This makes the green more visible from tee area 12, and the lowered front portion of green 18 provides less of an obstruction for golf balls hit towards green 18. In one embodiment, the slope of the concave surface on green 18 has a pitch of approximately 1:4. A backstop 74 may be erected behind green 18 to restrict the flight of golf balls that are hit over green 18 or bounce off of surface 34.

In operation, one or more golfers or players may hit golf balls from respective hitting regions 14 of tee area 12 to one of the greens 18*a*-*i* in fairway 16. Any ball that lands and stays on a green will be pulled by gravity into the respective hole 24 because of the concave shape of the green, so that any ball that lands on and stays on one of the greens will result in a "hole in one." Once entering hole 24, the ball will drop through cup 50 and out the bottom opening 52 into tube 54. The ball diverter 56 will then divert the golf ball into ball return line 58, where sensor 52, which may have either a known mechanical or light-emitting sensor, will sense or detect the presence of the ball. The sensor can provide a signal to an indicator (not shown) to let the player receive a visual or audio signal that the ball landed on the green and entered hole 24. It should be appreciated that balls received in ball dispenser 62 may be retrieved there when desired, or alternately, the ball return line may continue back to tee area 12.

Figures 5, 5A:
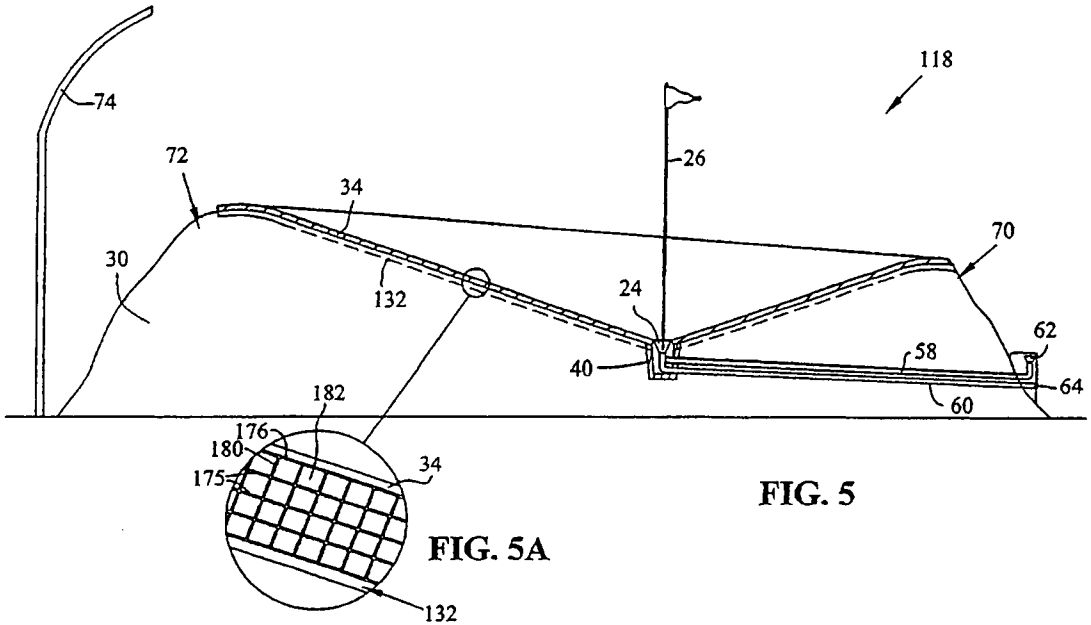
FIG. 5 is a cross-sectional view of an alternate embodiment green taken similar to that of FIG. 4 and including a corrugated plastic underlayment.
FIG. 5A is an enlarged view taken in the area indicated in FIG. 5 showing the corrugated plastic underlayment.

Now referring to FIGS. 5 and 5A, an alternate embodiment green is generally indicated as 118. Green 118 is similar in most respects to green 18 except that it includes an alternate underlayment support 132 that has a resiliently compressible construction. The resiliently compressible construction provides green 118 with desirable ball-rebounding characteristics. The compressible nature of the underlayment support absorbs impact from a ball striking thereon, so that balls striking the green will not have an excessive tendency to bounce off of it. Of course, the surface is not so soft that even hard line drive balls will be trapped in the green and not deflected away. Any suitable underlayment support material may be used that provides the desired compressible resilience, such as a foam or rubber material; however, in the embodiment shown, underlayment support 132 includes several plies 175 of corrugated or rectangular matrix material that is commonly used for plastic box stock. Each of the plies consists of an upper layer 176, a bottom layer 178, and one or more intermediate layers 180 extending between layers 176, 178. Corrugated or matrix construction plies 175 creates a number of laterally extending air cavities or channels 182. It should be appreciated that use of this embodiment for underlayment support 132 provides both desirable ball rebound characteristics and a resistance to moisture penetration.

Figure 8:
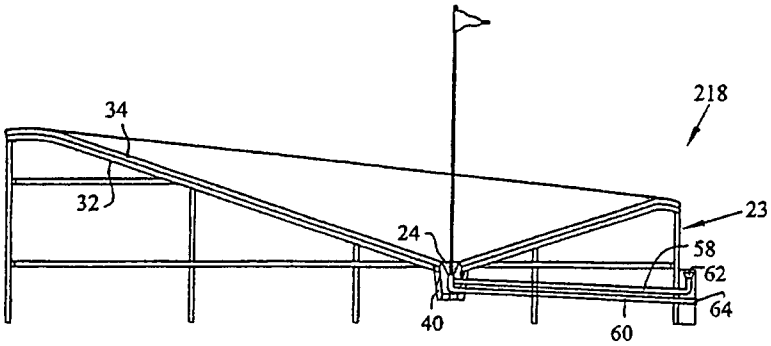
FIG. 8 is a cross-sectional view of a portable version of the green of the subject invention.

Now referring to FIG. 8, another embodiment of a green in accordance with the present invention is generally indicated as 218. Green 218 is similar in most respects to greens 18 and 118; however, instead of being constructed on a mound 30, green 218 is supported by a frame generally indicated as 231. The use of such a frame makes the green portable so that the location of green 218 can be varied in fairway 16, or alternately, green 218 can be erected in any desired location such as a player's yard and moved where desired.

Now referring to FIGS. 6 and 7, a method for playing a game on the greens of the invention is shown. For this game, players may toss (by hand) or hit (with a club or other instrument) a ball 90 in a direction substantially perpendicular to a radii R of the concave golf green. As shown in FIG. 6, this will cause the ball to travel in a spiral manner. Ball 90 is shown in various positions in FIG. 6 as it travels in the spiral course around hole 24. The spiral gets tighter and tighter until ball 90 ultimately drops in hole 24. If two or more players are participating, it is desirable to use balls having different colors or easily recognizable designs printed thereon. The players hit their balls approximately simultaneously, and the different colors or designs enable the players to identify when and in what order their ball goes in the hole. In one version of the game, the players are spaced circumferentially offset from one another around the golf green so that the players may toss or hit their balls to roll simultaneously on the green without running into one another. In one version, the balls are tossed or hit so that they all travel in the same general direction in a spiral manner on the golf green. However, in another version, the balls may be hit or tossed on the green so as to travel in opposite directions from one another. This may enhance the visual aspects of the game as well as creating the risk and excitement of having collisions of some of the balls. As should be appreciated, if two balls are engaged in a collision while additional balls are still traveling on the green, it is likely that the balls engaged in the collision will stop traveling in a spiral manner and likely enter the hole before the balls not engaged in a collision. The players may be spaced equidistant apart from one another about the green.

In another version of the game, the last ball to enter the hole is the winner of that round. It should be appreciated that this is a game of skill as a ball hit or tossed too hard will jettison from the green, and if the ball is hit too softly, it will tend to have less revolutions, traveling around the green and going quickly in the hole.

While the invention has been taught with specific reference to these embodiments, one skilled in the art will recognize that changes can be made in form and detail without departing from the spirit and scope of the invention. The described embodiments are to be considered, therefore, in all respects only as illustrative and not restrictive. As such, the scope of the invention is indicated by the following claims rather than by the description.

The invention claimed is:

1. A method of playing a game on a golf green comprising the steps of:

providing a concave golf green having a ball receptacle located at a low point on said green;

providing a plurality of golf balls being clearly distinguishable from one another by color or design;

having at least three participants of the game each simultaneously rolling a golf ball on said green and intentionally directing their respective rolled golf ball in a direction substantially perpendicular to radii of said concave golf green; and monitoring said golf balls to determine in what order said balls enter said ball receptacle for each of said balls, said monitoring operation performed by a sensor located in a tube attached to said receptacle, said sensor detecting each ball in an order received in the receptacle to determine the order thereof.

2. The method of playing a game as set forth in claim 1, wherein the last ball to enter said ball receptacle is the winner.

3. The method of playing a game as set forth in claim 1, wherein said golf green includes at least one layer of corrugated plastic material.

4. The method of playing a game as set forth in claim 1, wherein said concave golf green is mounted on a portable frame.

5. The method of playing a game as set forth in claim 1, wherein any balls that are rolled too hard will jettison from the green, and any balls rolled too softly will tend to have less revolutions traveling around said green and go quickly into said ball receptacle.

6. The method of playing a game as set forth in claim 1, wherein the balls rolling on said green travel in a spiral course around said ball receptacle.

7. The method of playing a game as set forth in claim 6, wherein the spiral course gets tighter and tighter until the ball drops into said ball receptacle.

8. The method of playing a game as set forth in claim 1, wherein the participants toss their balls on said concave golf green, by releasing said balls from said participants' hands.

9. The method of playing a game as set forth in claim 1, wherein the participants roll their ball from circumferentially offset positions around said green.

10. The method of playing a game as set forth in claim 9, wherein said participants are spaced equidistant about said golf green.

11. A method of playing a game on the golf green comprising the steps of:

providing a concave golf green having a ball receptacle located at a low point on said green;

providing a plurality of golf balls being clearly distinguishable from one another by color or design;

having at least three participants of the game each simultaneously rolling a ball on said green;

locating said participants of the game at circumferentially offset positions around said golf green, and providing a sensor to detect and monitor the order in which each of the golf balls enter the ball receptacle.

12. The method of playing a game as set forth in claim 11, wherein said participants are spaced at approximate equal distances from one another around the circumference of said golf green.

13. The method of playing a game as set forth in claim 11, wherein the participants intentionally direct said rolled golf balls in a direction substantially perpendicular to radii of said golf green to initiate the balls rolling in a spiral manner on said green.

14. The method of playing a game as set forth in claim 11, wherein at least some of the participants roll their respective balls in an opposite direction from one another.

* * * * *